US005880382A

United States Patent [19]

Fang et al.

[11] Patent Number: 5,880,382

[45] Date of Patent: Mar. 9, 1999

[54] DOUBLE CEMENTED CARBIDE COMPOSITES

[75] Inventors: Zhigang Fang; J. Albert Sue, both of The Woodlands, Tex.

[73] Assignee: Smith International, Inc., Houston, Tex.

[21] Appl. No.: 904,206

[22] Filed: Jul. 31, 1997

[51] Int. Cl.[6] ..... C22C 29/00

[52] U.S. Cl. ..... 75/236; 75/240; 75/242; 75/244; 501/93; 428/698; 51/309; 175/374; 175/420.1

[58] Field of Search ..... 75/236, 242, 240, 75/244; 501/93; 428/698; 51/307, 309; 175/374, 420.1

[56] References Cited

U.S. PATENT DOCUMENTS

| | | | |
|---|---|---|---|
| 4,017,480 | 4/1977 | Baum | 428/601 |
| 4,142,888 | 3/1979 | Rozmus | 75/201 |
| 4,341,557 | 7/1982 | Lizenby | 75/223 |
| 4,368,788 | 1/1983 | Drake | 175/374 |
| 4,372,404 | 2/1983 | Drake | 175/374 |
| 4,398,952 | 8/1983 | Drake | 419/18 |
| 4,428,906 | 1/1984 | Rozmus | 419/48 |
| 4,608,318 | 8/1986 | Makrides et al. | 428/553 |
| 4,656,002 | 4/1987 | Lizenby et al. | 419/10 |
| 4,673,549 | 6/1987 | Ecer | 419/10 |
| 4,723,996 | 2/1988 | Brunet et al. | 75/10.14 |
| 4,744,943 | 5/1988 | Timm | 419/10 |
| 4,945,073 | 7/1990 | Dubensky et al. | 501/93 |
| 5,089,182 | 2/1992 | Findeisen et al. | 264/8 |
| 5,290,507 | 3/1994 | Runkle | 419/14 |
| 5,358,545 | 10/1994 | Nagro | 75/236 |
| 5,423,899 | 6/1995 | Krall et al. | 75/231 |
| 5,593,474 | 1/1997 | Keshavan et al. | 75/240 |
| 5,653,299 | 8/1997 | Sreshta et al. | 175/374 |

FOREIGN PATENT DOCUMENTS

| | | |
|---|---|---|
| 0052922 | 6/1982 | European Pat. Off. . |
| 1574615 | 9/1980 | United Kingdom . |
| 2239028 | 6/1991 | United Kingdom . |
| WO81/03295 | 11/1981 | WIPO . |

*Primary Examiner*—Ngoclan Mai
*Attorney, Agent, or Firm*—Christie, Parker & Hale, LLP

[57] ABSTRACT

Double cemented carbide composites comprise a plurality of first regions and a second ductile phase that separate the first regions from each other. Each first region comprises a composite of grains and a first ductile phase bonding the grains. The grains are selected from the group of carbides consisting of W, Ti, Mo, Nb, V, Hf, Ta, and Cr carbides. The first ductile phase is selected from the group consisting of Co, Ni, Fe, alloys thereof, and alloys with materials selected from the group consisting of C, B, Cr, Si, and Mn. A preferred first region comprises tungsten carbide grains that are cemented with a cobalt first binder phase and which are in the form of substantially spherical pellets. The second ductile phase is selected from the group consisting of Co, Ni, Fe, W, Mo, Ti, Ta, V, Nb, alloys thereof, and alloys with materials selected from the group consisting of C, B, Cr, and Mn. A preferred second ductile phase is cobalt. Additionally, additives such as those selected from the group consisting of carbides, nitrides, and borides can be added to the second ductile phase to provide improved properties of wear resistance. The composites are prepared by combining hard phase particles formed from the grains and first ductile phase, with the second ductile phase material under conditions of pressure and heat, and have improved properties of fracture toughness and equal or better wear resistance when compared to conventional cemented tungsten carbide materials.

41 Claims, 7 Drawing Sheets

30.0
25.0
20.0
15.0
10.0
5.0
$K_{IC}$(ksi in$^{1/2}$)
0
1
2
3
4
5
6
7
8
9
10
B611 WEAR NUMBER(1000rev/cc)
8
6
9
7
◆ CONVENTIONAL WC/CO
▲ EXAMPLES 6 TO 9
— TRENDLINE: WC/Co

DOUBLE CEMENTED CARBIDE COMPOSITES

This application claims benefit of provisional application Ser. No. 60/023,656, filed Aug. 1, 1996 and provisional application Ser. No. 60/041,111 filed Mar. 20, 1997.

FIELD OF THE INVENTION

This invention relates to cemented tungsten carbide materials and methods of making the same and, more particularly this invention relates to double cemented carbide composites that have improved properties of toughness without sacrificing wear resistance when compared to conventional cemented tungsten carbide.

BACKGROUND OF THE INVENTION

Cemented tungsten carbide, such as WC—Co is well known for its mechanical properties of hardness, toughness and wear resistance, making it a popular material of choice for use in such industrial applications as mining and drilling where its mechanical properties are highly desired. Because of its desired properties, cemented tungsten carbide has been the dominant material used as cutting tools for machining, hard facing, wear inserts, and cutting inserts in rotary cone rock bits, and substrate bodies for drag bit shear cutters. The mechanical properties associated with cemented tungsten carbide and other cermets, especially the unique combination of hardness toughness and wear resistance, make these materials more desirable than either metals or ceramics alone.

For conventional cemented tungsten carbide, fracture toughness is inversely proportional to hardness, and wear resistance is proportional to hardness. Although the fracture toughness of cemented tungsten carbide has been somewhat improved over the years, it is still a limiting factor in demanding industrial applications such as high penetration drilling, where cemented tungsten carbide inserts often exhibit gross brittle fracture that leads to catastrophic failure. Traditional metallurgical methods for enhancing fracture toughness, such as grain size refinement, cobalt content optimization, and strengthening agents, have been substantially exhausted with respect to conventional cemented tungsten carbide. The mechanical properties of commercial grade cemented tungsten carbide can be varied within a particular envelope by adjusting cobalt metal content and grain sizes. For example, the Rockwell A hardness of cemented tungsten carbide can be varied from about 85 to 94, and the fracture toughness can be varied from about 8 to 19 $ksi.in^{-1/2}$. Applications of cemented tungsten carbide are limited to this envelope.

Another class of materials for cutting and wear applications is tool steel. In general, the wear resistance of steels, including tool steel, is much lower than that of cemented tungsten carbide. U.S. Pat. No. 5,290,507 describes a material that is formed by incorporating a certain percentage of cemented tungsten carbide granules into a matrix of tool steel binder to increase the wear resistance of the tool steel. Such tool steel/cemented tungsten carbide composite materials belong to the category of metal matrix composites, where the brittle phase, i.e., cemented tungsten carbide granules, is the minority phase.

A problem known to exist with tool steel/cemented tungsten carbide composites is that iron (Fe) present in the tool steel binder tends to react with the cemented tungsten carbide to form $Fe_3C$, which can be detrimental to the ductility and toughness of the composite. For this reason, such tool steel/cemented tungsten carbide composites are not desired for use in applications, such as those discussed above, where improved toughness is needed. Additionally, the limited ductility of the tool steel that is used to form the cemented tungsten carbide composite also acts to limit the overall toughness of the composite, thereby limiting its use.

It is, therefore, desirable that a cemented tungsten carbide composite be developed that has improved properties of fracture toughness when compared to conventional cemented tungsten carbide materials. It is desirable that such cemented tungsten carbide composite have such improved fracture toughness without sacrificing wear resistance, i.e., having equal or better wear resistance than that of conventional cemented tungsten carbide materials. It is desired that such cemented tungsten carbide composites be adapted for use in such applications as roller cone bits, percussion or hammer bits and drag bits, and other applications such as mining and construction tools where properties of improved fracture toughness is desired.

SUMMARY OF THE INVENTION

Double cemented carbide composites of this invention comprise a plurality of first regions and a second ductile phase that separate the first regions from each other. Each first region comprises a composite of grains and a first ductile phase bonding the grains. The grains are selected from the group of carbides consisting of W, Ti, Mo, Nb, V, Hf, Ta, and Cr carbides. The first ductile phase is selected from the group consisting of Co, Ni, Fe, alloys thereof, and alloys with materials selected from the group consisting of C, B, Cr, Si and Mn. A preferred first region comprises tungsten carbide grains that are cemented with a cobalt first binder phase. The second ductile phase is selected from the group consisting of Co, Ni, Fe, W, Mo, Ti, Ta, V, Nb, alloys thereof, and alloys with materials selected from the group consisting of C, B, Cr, and Mn. A preferred second ductile phase is cobalt. Additionally, additives such as those selected from the additive selected from the group consisting of carbides, nitrides, and borides can be added to the second ductile phase to provide improved properties of wear resistance.

Double cemented carbide composites of this invention are prepared by combining hard phase particles (e.g., WC—Co) formed from the grains and first ductile phase, with the second ductile phase material under conditions of pressure and heat. The composite comprises in the range of from about 40 to 95 percent by volume first regions, and less than about 60 percent by volume second ductile phase based on the total volume of the composite, and more preferably comprises in the range of from about 60 to 80 percent by volume first regions and in the range of from about 20 to 40 percent by volume second ductile phase based on the total volume of the composite. Composite embodiments comprising an additive in the second ductile binder comprise less than about 40 percent by volume of the additive based on the total volume of the second ductile binder.

Double cemented carbide composites of this invention have improved properties of fracture toughness when compared to conventional cemented tungsten carbide materials, without sacrificing wear resistance, i.e., having equal or better wear resistance than that of conventional cemented tungsten carbide materials, making the material well suited for such applications as roller cone bits, percussion or hammer bits, drag bits, and other applications such as mining and construction tools where properties of improved fracture toughness is desired. For example, double cemented carbide composites of this invention have a $K_{Ic}$ fracture toughness of greater than 20 ksi.in$^{-1/2}$, and a wear number of at least 1.5 (1,000 rev/cm$^3$).

DESCRIPTION OF THE DRAWINGS

These and other features and advantages of the present invention will become appreciated as the same becomes better understood with reference to the specification, claims and drawings wherein:

DETAILED DESCRIPTION

Figure 1:
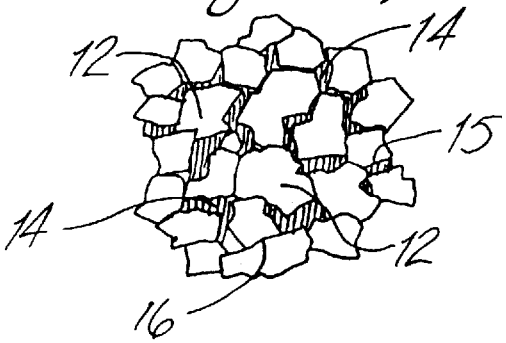
FIG. 1 is a schematic photomicrograph of a portion of conventional cemented tungsten carbide.

Cemented tungsten carbide is a composite material that is made from tungsten carbide (WC) grains and a metallic binder such as cobalt (Co), thereby forming WC—Co. FIG. 1 illustrates a conventional microstructure of a cemented tungsten carbide material 10, comprising tungsten carbide grains 12 that are bonded to one another by the binder phase 14, e.g., cobalt material. The unique properties of cemented tungsten carbide, e.g., toughness, hardness, and wear resistance, result from the combination of a rigid carbide network with a tougher metal substructure. The generic structure of cemented tungsten carbide, a heterogeneous composite of a ceramic phase in combination with a metal phase, is similar in all cermets.

Figure 2:
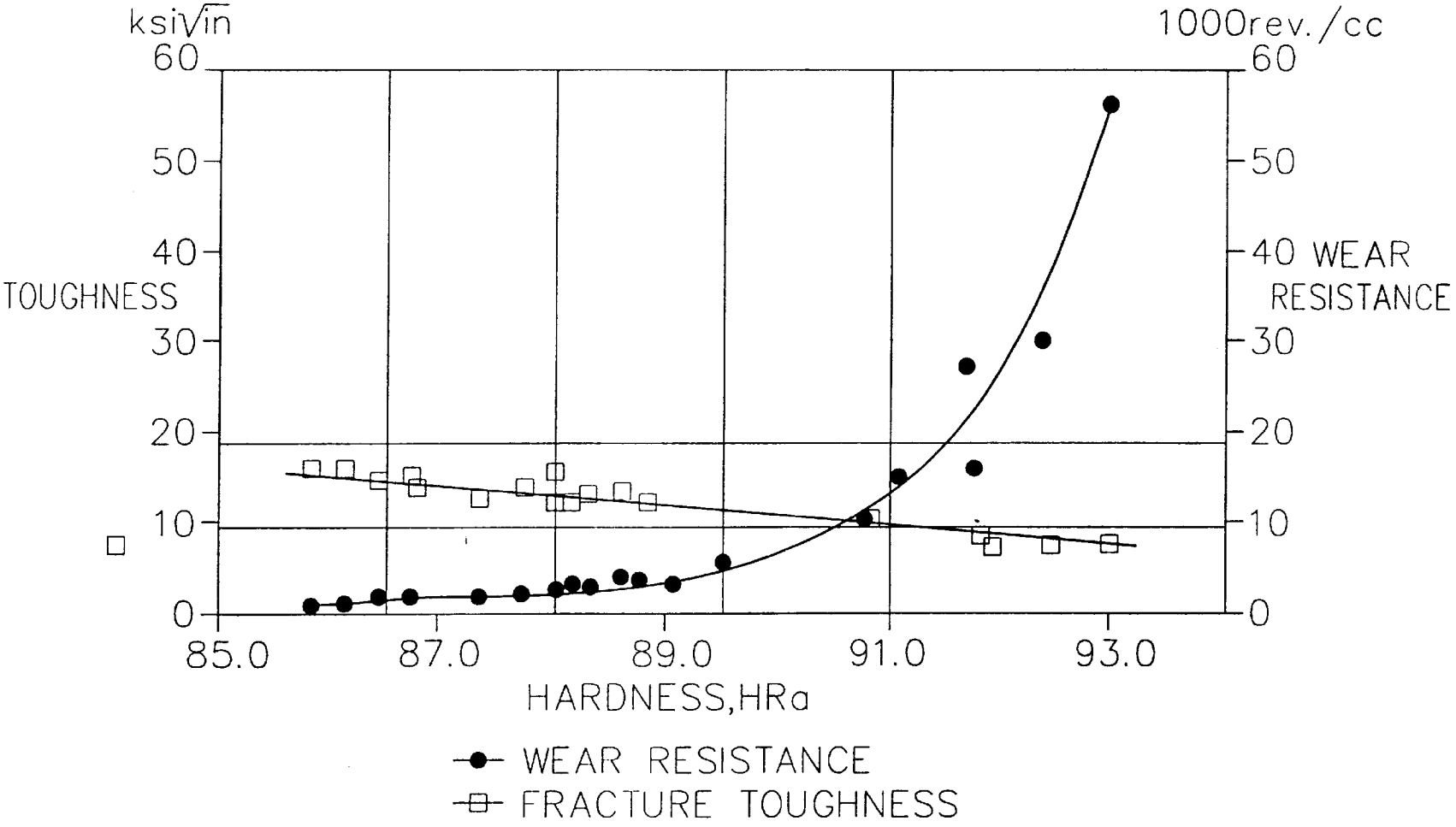
FIG. 2 is a graphical representation of the relationship between the properties of toughness, hardness and wear resistance for a conventional cemented tungsten carbide material having the microstructure of FIG. 1.
Figure 3:
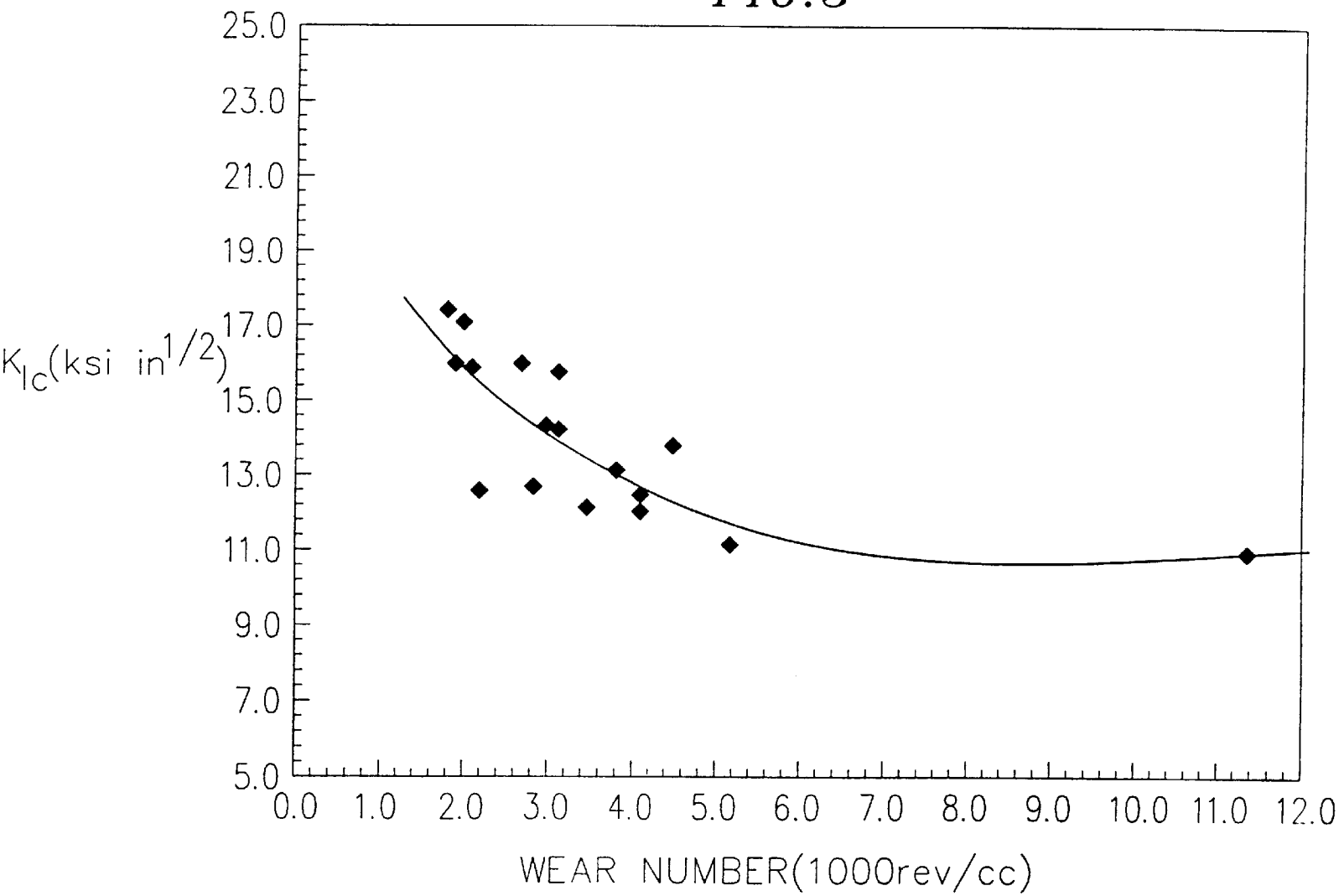
FIG. 3 is a graphical representation of the relationship between the properties of fracture toughness and wear resistance for a conventional cemented tungsten carbide material of FIG. 1.

The relationship between mechanical properties of hardness, fracture toughness and wear resistance is well known for such conventional commercial grade cemented tungsten carbide materials, and is illustrated in graphical form in FIG. 2. Hardness is indicated by Rockwell A (HRa) number, fracture toughness is indicated by $K_{Ic}$ value (ksi.in$^{1/2}$), and wear resistance is indicated by wear number (1,000 rev/cm$^3$). As illustrated in FIG. 2, properties of toughness and hardness are inversely proportional to one another, while properties of hardness and wear resistance are proportional to one another. FIG. 3 is another presentation of the relationship between fracture toughness and wear resistance for conventional commercial grade cemented tungsten carbide.

For conventional cemented tungsten carbide materials, properties of hardness, fracture toughness and wear resistance can be varied within a defined window of between 85 to 94 HRa (hardness), between 8 to 19 ksi.in$^{-1/2}$ (fracture toughness), and between 1 to 15 (1,000 rev/cm$^3$—wear resistance). For example, it is known to increase the fracture toughness of such conventional cemented tungsten carbide materials to the higher end of the $K_{Ic}$ envelope by increasing the amount of cobalt present in the cemented tungsten carbide. The toughness of the cemented tungsten carbide comes mainly from the plastic deformation of the cobalt phase during the fracture process. Yet, the resulting hardness of the cemented tungsten carbide decreases as the amount of ductile cobalt increases. In most commonly used cemented tungsten carbide grades, cobalt is no more than about 20 percent by weight of the total composite.

Conventional grades of cemented tungsten carbide used for shear cutter substrates in drag bits and cutting structure inserts in rock drilling bits contain in the range of from about 6 to 16 percent by weight cobalt, and have grain sizes in the range of from about one to ten micrometers. Such conventional grades of cemented tungsten carbide used for cutting structure inserts in rock drilling bits have a Ra hardness in the range of from about 85 to 91, a fracture toughness in the range of from about 9 to 18 ksi.in$^{-1/2}$, and have a wear number in the range of from about 1.5 to 11 (1,000 rev/cm$^3$).

Referring back to FIG. 1, it is evident that the cobalt phase 14 is not continuous in the conventional cemented tungsten carbide microstructure, particularly in compositions with a low cobalt concentration. The conventional microstructure has a relatively uniform distribution of tungsten carbide in a cobalt matrix. Thus, crack propagation through the composite will often travel through the less ductile tungsten carbide grains, either transgranularly through tungsten carbide/cobalt interfaces 15, or intergranularly through tungsten carbide/tungsten carbide interfaces 16. As a result, cemented tungsten carbide often exhibits gross brittle fracture during more demanding applications, which may lead to catastrophic failure.

Figure 4:
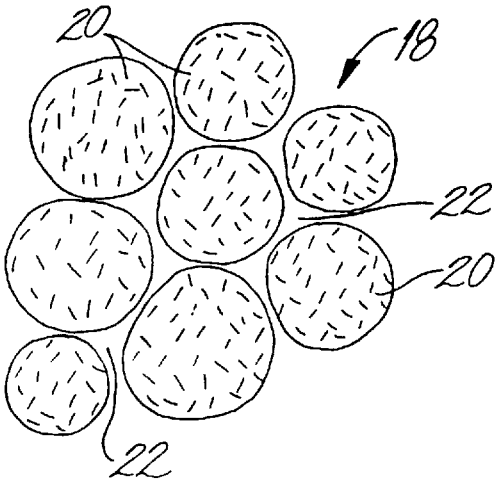
FIG. 4 is a schematic photomicrograph of a portion of a double cemented carbide composite prepared according to principles of this invention.

FIG. 4, illustrates the microstructure of a double cemented carbide composite 18 prepared according to principles of this invention. The class of cermets prepared according to this invention have a double cemented microstructure. A first cemented microstructure comprises a conventional cemented carbide microstructure (e.g., cemented tungsten carbide, WC—Co) as described above, while a second cemented microstructure comprises hard phase particles 20 formed from the first cemented microstructure (e.g., WC—Co particles) surrounded by a continuous ductile binder phase 22 (e.g., formed from a ductile metal or metal alloy). Thus the term "double cemented" or "dual cemented" is used to refer to the fact that the composite material of this invention is in the form of a cemented microstructure that itself comprises a cemented microstructure as one of its components. Double cemented composites of this invention are formed using materials and processes that achieve the desired enhanced properties of fracture toughness without sacrificing wear resistance.

Broadly, double cemented carbide composites of this invention are made by mingling cemented hard phase particles with a ductile phase binder under conditions causing the cemented hard phase particles to be cemented by the ductile phase binder. From a laminate perspective, a conventional laminate structure comprises a stack of sheets that has alternating materials along one geometric dimension. A fiber structure with a binder is considered to be a 2-D laminate. The double cemented carbide composite of this invention can, therefore, be viewed to be a 3-D laminate.

The microstructure of double cemented carbide composites of this invention provides a structure that has a much higher fracture toughness than conventional cemented tungsten carbide due to the enhanced crack blunting and deflective effects of the continuous binder phase 22 that surrounds each hard phase particle 20. The continuous binder phase increases the overall fracture toughness of the composite, by blunting or deflecting the front of a propagating crack if one occurs, without sacrificing either the overall hardness or wear resistance of the composite. The overall hardness of the composite is not sacrificed as the original ductile metal phase of the hard particles (e.g., the cobalt phase of the cemented tungsten carbide hard particles) is merely redistributed between the hard particle phase and the new or second binder phase. The overall wear resistance of the double cemented composite is much higher than that of a conventional cemented tungsten carbide material that comprises the same amount of the total ductile binder phase material.

Double cemented carbide composites of this invention can be formed using different types of materials as the hard phase particles 20. Suitable materials for forming the hard phase particles 20 are cermets that include hard grains formed from carbides or borides formed from refractory metals such as W, Ti, Mo, Nb, V, Hf, Ta, Cr, and a metallic cementing agent. Example hard grain materials include WC, TiC, TaC, $TiB_2$, or $Cr_2C_3$. The metallic cementing agent may be selected from the group of ductile materials including one or a combination of Co, Ni, Fe, which may be alloyed with each other or with C, B, Cr, Si and Mn. Preferred cermets useful for forming the hard phase particles 20 include cemented tungsten carbide with cobalt as the binder phase (WC—Co) and other cermets such as WC—Ni, WC—Fe, WC—(Co, Ni, Fe) and their alloys.

The hard phase particles 20 useful for forming double carbide composites of this invention include conventional cermets, such as cemented tungsten carbide, having the following composition range: carbide component in the range of from about 75 to 97 percent by weight, and metallic cementing agent or binder in the range of from about 3 to 25 percent by weight.

The hard phase particles 20 can also be formed from spherical cast carbide. Spherical cast carbide may be fabricated using the spinning disk rapid solidification process described in U.S. Pat. No. 4,723,996 and U.S. Pat. No. 5,089,182. Spherical cast carbide is a eutectic of WC and $W_2C$. If desired, the hard phase particles 20 can be formed from mixtures of cemented tungsten carbide and spherical cast carbide, or combinations of other hard phase particles described above.

In an exemplary embodiment, the hard phase particles are formed from conventional cemented tungsten carbide, as illustrated in FIG. 1, wherein each particle comprises a composite of tungsten carbide grains bonded by cobalt (WC—Co). The cemented tungsten carbide particles can be made by conventional mixing, pressing, and sintering to form a cemented tungsten carbide body. Such a body can then be crushed and screened to obtain a desired particle size for use in this invention. Alternatively, the particles can be made directly by forming agglomerates of tungsten carbide and cobalt of appropriate size which are then sintered to near net size. This enables one to determine the shape as well as the size of the particles.

Hard phase particles 20 made from cemented tungsten carbide are preferably in the form of substantially spherical particles. Such spherical particles can be made from pelletized mixtures of cobalt and tungsten carbide particles or by abrading crushed cemented tungsten carbide. The preferred substantially spherical cemented tungsten carbide pellets are bonded with cobalt. Probably 90% or more of the pellets are spherical or very nearly spherical. A small fraction are smooth but somewhat oval (oblate or prolate) or egg shaped. This is contrasted with fractured carbide which has an angular profile.

The cemented tungsten carbide pellets have a particle size that is preferably less than about 500 micrometers because while larger sized particles may exhibit better wear resistance, they are known to display a higher tendency for independent particles to microcrack or pull-out during abrasive wear situations.

In a preferred embodiment, the cemented tungsten carbide pellets have a particle size in the range of from about 20 to 300 micrometers. A hard phase pellet size within this range is preferred because it provides a good combination of resistance to both wear and cracking. Cemented tungsten carbide pellets that are too fine, e.g., that have a particle size of less than about 20 micrometers, are also not desired because while such particles may display a low tendency to crack, as the particle size of the cemented tungsten carbide approaches the size of the individual carbide grains, the microstructure of the composite approaches that of conventional cemented tungsten carbide.

The relative size and volume fraction of the hard phase particles 20 and the ductile binder phase 22 surrounding the hard phase particles determine the combined mechanical and tribological behavior of the final composites. Double cemented carbide composites of this invention may comprise in the range of from about 40 to 95 percent by volume of the hard phase particles 20 based on the total volume of the composite. The volume fraction of that hard phase particles is one of the most important factors affecting the mechanical properties of the final composite. It is desired that double cemented carbide composites be prepared using greater than about 40 percent by volume hard phase particles because using less than this amount can produce a final composite having an overall modulus, and properties of strength and wear resistance that are too low for demanding applications such as shear cutter substrates for drag bits or inserts for roller cone rock bits. It is desired that double cemented carbide composites of this invention be prepared using less than 95 percent by volume hard phase particles because using more than this amount can produce a final composite having a low fracture toughness similar to that of conventional cemented tungsten carbide.

The exact amount of the hard phase particles 20 that are used will vary depending on the desired mechanical properties for a particular application. For example, when the double cemented carbide composite is used in an earth boring drill bit, it is preferred that the hard phase particles be in the range of from about 60 to 80 percent by volume of the total volume of the composite.

The ductile binder phase 22 of double cemented carbide composites of this invention is selected from the group of materials comprising one or more ductile metal, ductile metal alloy, refractory metals, additives, and mixtures thereof. In a first embodiment double cemented carbide composite, the ductile binder phase 22 that surrounds the hard phase particles 20 is selected from the group of ductile metals, ductile metal alloys, and refractory metals. The ductile metals can include cobalt, nickel, iron, cast iron, and the ductile metal alloys can include steels of various carbon and alloying levels, stainless steels, cobalt alloys, nickel alloys, Fe—Ni—Co alloys having a low coefficient of thermal expansion such as Sealvar manufactured by Amtec Inc., of Pennsylvania, tungsten alloys such as W—Ni—Fe, and the like. Desirable low thermal expansion alloys include those having a coefficient of thermal expansion of less than about 8 $\mu$m/m-K. Such low thermal expansion alloys are desired because they are both thermally compatible with the hard phase particles, thereby improving thermal fatigue crack resistance, and because they are more ductile the most commercial grade steels. The ductile binder phase 22 can be one, or a combination of, the following: W, Co, Ni, Fe, Mo, Ti, Ta, V, Nb. The ductile binder phase 22 can be alloyed with C, B, Cr and Mn.

Co is a preferred ductile binder phase material when the hard phase particles are formed from cemented tungsten carbide (WC—Co) because it has better thermodynamic compatibility, wetting, and interfacial bonding with WC grains, as compared to nickel or iron. Cemented tungsten carbide comprising cobalt as a binder offers the best combination of hardness and toughness when compared to that formed by using other binder systems. Other binder materials such as nickel are useful in certain applications where other enhanced properties are desired, e.g., nickel is used as a binder in applications where superior corrosion resistance is needed.

In the first embodiment, where the ductile binder phase 22 comprises a ductile metal, ductile metal alloy, or combination thereof, it is desired that the double cemented carbide composite comprise less than about 60 percent by volume, and more preferably in the range of from about 20 to 40 percent by volume, of the ductile binder phase based on the total volume of the composite. The function of the ductile binder phase is to enhance the fracture toughness of the final composite by plastically deforming during crack propagation. The overall elastic modulas, compressive strength, and wear resistance of the final composite will decrease significantly if greater than about 60 percent by volume of the ductile binder is used, making the final composite unsuited for applications where extremely heavy load and abrasive wear is known to occur.

Materials useful as the ductile binder phase 22 include ductile steel. The term "ductile steel" is used herein to refer to a mild steels that display greater than about 5 percent elongation after heat treatment, have a carbon content of less than about 0.8 percent by weight, and have a total alloy content of less than about 5 percent by weight of the total steel composition. Such steels, because of their make up and heat treatment, have a desired degree of ductility to plastically deform a sufficient amount during crack propagation and, thereby increase the fracture toughness of the double cemented carbide composite. It is understood that such ductile steels do not include steels having: (1) an elongation greater then about 5 percent after heat treatment; or alloyed steels that both have a carbon content of greater than about 0.8 percent by weight, and have a total alloy content of greater than about 5 percent by weight, that may be referred to as tool or high-speed steels. The term "alloyed steel" as used herein refers to those steels that include alloys of such metals as W, Co, Ni, Fe, Mo, Ti, Ta, V, Nb, Cr, Mn and the like.

The initial particle size and size distribution of the powder affects the mixing and homogeneity of the final microstructure of the composite. The surface finish of the as-consolidated part is also affected by the initial particle size and size distribution of both the ductile binder phase and hard phase powders. After consolidation, it is desired that the hard phase particles retain their integrity with some elemental diffusion, which may occur during high temperature consolidation process. The ductile binder phase particles, however, becomes a continuous or semi-continuous matrix phase during such consolidation, its original powder characteristics no longer exist, and it has a structure similar to bulk metals with equi-axed grains, although subsequent heat treatment could alter its grain structure. For example, if ductile steel is used as the ductile binder phase, its microstructure can be martensite, pearlite, bainite or others depending on the specific heat treatment or thermal history of the material. At the interface between the binder alloy and hard phase particles there could be diffusion bonding depending on the specific material systems.

In a second embodiment double cemented carbide composite, the ductile binder phase 22 includes one or more of the materials described above for the first embodiment plus one or more particulate additives. Suitable additives include WC, VC, NbC, $TiB_2$, TiC, MoC, $Cr_3C_7$, polycrystalline diamond (PCD), cBN, other carbides, borides, nitrides, carbonitrides, carboborides, and mixtures thereof Additives, in this second embodiment, are an integral part of the ductile binder phase. In many abrasive wear applications, preferential wear of the binder phase is the primary wear mechanism. Strengthening and increasing the wear resistance of the binder phase also enhances the wear resistance of the final composite. The particle size of the additives needs to be smaller than that of the hard phase particles, and also needs to be small enough to be uniformly distributed through the binder phase. As a general principle of precipitation or dispersion strengthening, useful particles include those ranging from submicron to a few microns in size. Particle sizes of strengthening additives are much smaller than the mean free path between pellets. In other words, the particle sizes are smaller than the width of the ductile binder phase between the pellets of cemented tungsten carbide.

Depending on different wear applications, additives useful for forming second embodiment composites of this invention may have a particle size in as large as about 20 micrometers. In a preferred second embodiment, the additives have a submicron particle size, or a particle size in the range of from about one to ten micrometers. In some instances, nanometer powders such as the Nanocarb powder (WC/Co) manufactured by Nanodyne, Inc., of New Brunswick, N.J., may be used. The selection of additive depends on the particular application. The use of such fine particle size additives is desired to strengthen the ductile binder phase, reduce preferential wear of the ductile binder phase, and improve the overall wear resistance/toughness combination of the double cemented carbide composite.

In such second embodiment double cemented carbide composite, where the ductile binder phase 22 comprises an additive in addition to a ductile metal or ductile metal alloy, it is desired that the double cemented carbide composite comprise less than about 60 percent by volume of the binder (i.e.,ductile metal or ductile metal alloy) based on the total volume of the composite, and less than about 30 percent by volume of the additive based on the total volume of the binder, although a preferred amount of the additive is approximately 15 percent by volume. The use of such strengthening additives may have an adverse impact on the ductility of the binder. As a general rule, as you increase the strength of the binder you decrease the ductility of the binder. Using less than about 30 percent by volume of the additive, based on the total volume of the binder, has been shown to provide a desirable degree of wear resistance without significantly sacrificing ductility or toughness, while if the volume fraction of the additives is greater than about 30 percent, the fracture toughness or the final composite may be below what is needed for particular applications.

Double cemented carbide composites of this invention can be prepared by a number of different methods, e.g., by rapid omnidirectional compaction (ROC) process, hot pressing, infiltration, solid state or liquid phase sintering, hot isostatic pressing (HIP), pneumatic isostatic forging, and combinations thereof. These processes are desired because they are needed to form the desired composite microstructure of this invention having a uniform distribution of hard phase particles within the ductile phase, thereby producing improved properties of fracture toughness without sacrificing wear resistance. Initially, the hard phase particles that are used to make cemented tungsten carbide composites of this invention can be formed into pellets by conventional methods.

Specifically, where the hard phase particles 20 are formed from sintered or cemented tungsten carbide having, for example, about 1 to 15 micrometer WC particles bonded together by six percent cobalt, such pellets are made by conventional closed die pressing of a cemented tungsten carbide powder mixture, dewaxing and vacuum sintering. The resulting product can be crushed to form particles in the range of from about 20 to 300 micrometers. Alternatively, WC and Co powders can be mixed with a temporary wax binder in an attritor or ball mill and pellets in the range of 20 to 300 micrometers (size after sintering) screened from the mixture. Oversize and undersize pellets are recycled to achieve the desired particle size range. The pellets are dewaxed and sintered and then broken up as required to provide 20 to 300 micrometer pellets. These pellets can then be formed into a double composite by any of the four above-mentioned processes. The Pellets are blended with the selected ductile binder phase 22 material, and this secondary mixture is pressed into a desired shape, such as the shape of a roller cone rock bit insert and the like. The pressed shapes are then sintered.

Liquid Phase Sintering

The second sintering of the pressed shapes may be done by liquid phase sintering where the double cemented carbide composite is heated above the melting point of the ductile metal or binder phase, or by supersolidus liquid phase sintering where the double cemented carbide composite is heated above the solidus temperature of the ductile binder phase or above an alloy composition formed by combination of the ductile metal phase and binder in the pellets, but below the full liquidus temperature. An advantage of liquid phase sintering over other composite forming processes is its relatively low cost, and the fact that it is well suited for mass production. A disadvantage of liquid phase sintering is that its use limits the selection of alloy systems to those where the binder alloy can form a liquid at a temperature below the liquid-forming temperature of the hard phase pellets. For example, WC—Co hard phase pellets have a liquefaction temperature of approximately 1,280° C., thus the liquid phase sintering temperature for the double cemented tungsten carbide composite of this invention has to be below 1,280° C. Melting depressant elements such as Si, B or C have to be used in combination with the steels, nickel, or cobalt metal in order to form a liquid during sintering. However, the properties of liquid phase sintered composite materials will be different from that of alloys without melting point depressant elements.

Hot Pressing

Alternatively, the secondary mixture may be hot pressed to a desired shape in a closed die at a temperature below the solidus temperature of the ductile binder phase for bonding by diffusion processes. Hot pressing can be conducted with or without a liquid phase to achieve full density. During the hot pressing process, green powder compact or loose packed powder is placed in a graphite die and is heated by the die to a desired temperature. The green powder compact or loose packed powder is pressed at the desired temperature under a pressure of about one to ten ksi for a predetermined length of time, e.g., 30 to 60 minutes. The hot pressing process is a viable production technology for double cemented carbide composites of this invention when compared to liquid phase sintering because its use permits a greater selection of binder alloy materials. Hindering factors of the hot press process for production include the high cost associated with graphite mold preparation, and moderate flexibility with respect to component geometry.

Hot Isostatic Pressing

The Hot isostatic press (HIP) process is another option for manufacturing double cemented carbide composites of this invention. The powder mixture of the hard phase particles and the ductile metal phase powder are first encapsulated in a soft metal case (steel in many applications) under a vacuum. During HIPing, the powder blend encapsulated in the metal case is consolidated by an inert pressurizing gas such as argon through the metal case at a predetermined temperature for in the range of from about 30 minutes to 2 hours. The HIP pressure is usually in the range of from about 10 to 30 ksi. The entire heating and cooling cycle for the HIP process is approximately 15 to 20 hours in a production environment.

Quasi-HIP Processes

There are other quasi-HIP process that can also be used for manufacturing double cemented carbide composites of this invention. An examples of such quasi-HIDING process is the Ceracon process as disclosed in U.S. Pat. No. 4,673,549, which is incorporated herein by reference. The Ceracon process is a pseudo hot isostatic pressing technique, where the shape is presintered and subjected to further compaction by hot isostatic pressing (HIDING) or quasi-HIDING process where spherical graphite granules are used as a pressure transmission media.

Rapid Omnidirectional Compaction

A preferred process is referred to as rapid omnidirectional compaction (ROC). Exemplary ROC processes are described in U.S. Pat. Nos. 4,945,073; 4,744,943; 4,656,002; 4,428,906; 4,341,557 and 4,142,888, which are hereby incorporated by reference. Broadly, the process involves forming a mixture of pellets and a powder of a ductile metal binder, along with a temporary wax binder. The mixture is pressed in a closed die to a desired shape, such as a rock bit insert. The resulting "green" insert is vacuum dewaxed and presintered at a relatively low temperature to achieve a density appreciably below full theoretical density. The sintering is only sufficient to permit handling of the insert for subsequent processing.

This green insert is wrapped in a first container and is then placed in second container made of a high temperature high pressure self-sealing ceramic material. The second container is filled with a special glass powder and the green parts disposed within the first container are embedded in the glass powder. The glass powder has a lower melting point than that of the green part, or of the ceramic die. The second container is placed in a furnace to raise it to the desired consolidation temperature, that is also above the melting point of the glass. For example, for a WC—Co hard phase pellet-cobalt ductile metal phase system, the consolidation temperature is in the range of from 1,000° C. to 1,500° C. The heated second container with the molten glass and green parts immersed inside is placed in a hydraulic press having a closed cylindrical die and ram that presses into the die. Molten glass and the green parts are subjected to high pressure in the sealed ceramic container. The parts are isostatically pressed by the liquid glass to pressure as high as 120 ksi. The temperature capability of the entire process can be as high as 1,800° C. The high pressure is applied for a short period of time, e.g., less than about five minutes and preferably one to two minutes, and isostatically compacts the green parts to essentially 100 percent density.

The ROC process has the following advantages when compared against the HIP process: (1) the pressure medium is a liquid rather than a gas, thereby allowing one to start with a shaped green part, rather than having to start with a powder blend that must be both encapsulated and evacuated before HIDING; (2) it permits near net-shape manufacturing without machining and is extremely flexible in geometry, unlike HIDING that requires post machining and is not suitable for small individual component manufacturing; (3) it operates at pressures as high as 120 ksi, rather than at low HIDING pressures of less than about 30 ksi; (4) it operates at high temperatures of up to about 1,800° C., rather than at HIDING temperatures of less than about 1,500° C.; (5) it has a short processing time of about one to two minutes at pressure and the heating and cooling operations are separate from the actual ROC process, rather than having a long HIDING process time of 30 to 120 minutes at temperature and pressure that requires long period for pressure and temperature ramp up, providing a typical cycle time of 10 to 20 hours; (6) it does not place a limit on the composition range for fall consolidation because the extremely high pressure causes a large amount of plastic deformation, unlike HIDING that limits the carbide composition if solid state consolidation is required, because the consolidation mechanism depends on creep and solid state diffusion; and (7) it produces a fully consolidated product having less micro defects such as micro porosity, unlike HIDING where the production of a porosity-free structure is dependent on the type of composition, e.g., the higher the carbide content, the higher the probability for micro porosity.

Double cemented carbide composites of this invention will become better understood and appreciated with reference to the following examples:

EXAMPLE 1

Double Cemented Tungsten Carbide Composite Prepared by Infiltration Process

Minus 200 mesh spherical WC—6Co sintered pellets were packaged in a graphite mold to the desired shape of an insert for use with a rotary cone rock bit. The pellets have an average particle size in the range of from about 40 to 50 micrometers. The pellets were pre-sintered in the mold in a vacuum at about 1,300° C. for approximately 30 minutes. The presintered inserts were then infiltrated with Nicrobraze LM, a nickel-based infiltration alloy manufactured by Wall Colmonoy, Inc. The infiltration temperature was controlled at approximately 1,050° C. for a period of approximately 30 minutes. For the samples used for infiltration, approximately 30 percent by weight of the Nicrobraze LM material was used to charge the mold. However, due to excess infiltrant pile up on the top and bottom of the samples, about 40 percent by volume (26 percent by weight) of nickel alloy was in the final as-infiltrated samples.

EXAMPLE 2

Double Cemented Tungsten Carbide Composite Prepared by Hot Press Process

Spherical WC—6Co sintered pellets having an estimated average particle size of approximately 40 to 50 micrometers were blended with a low-carbon ductile steel (i.e., the ductile binder phase material), such as Grade A1000C manufactured by Hoeganaes Corporation. Approximately 36 percent by volume (i.e., less than 25 percent by weight) of the ductile steel was used. The spherical pellets were minus 200 mesh, i.e. they passed through a standard 200 mesh screen. The blended powder was packed into a graphite mold that was coated with hBN, and then hot pressed at approximately 1,200° C. for one hour at a pressure of approximately six ksi.

EXAMPLE 3

Double Cemented Tungsten Carbide Composite Prepared by ROC Process

Spherical WC—6Co sintered pellets having an average particle size of approximately 40 to 50 micrometers were wet milled together with A1000C low-carbon ductile steel powder in heptane fluid, and approximately two percent by weight paraffin wax was added thereto. Approximately 36 percent by volume (i.e., less than 25 percent by weight) of the ductile steel was used. After milling, the powder was dried and it was pressed into green inserts on a uniaxial press to a specific dimension. The green insert was then presintered in a vacuum at approximately 950° C. for 30 minutes. The pre-sintered insert was then subject to a rapid omnidirectional compaction process at approximately 1,100° C. with 120 ksi pressure. Other ductile metal alloy binders were also used to fabricate samples using the ROC process. The samples were then evaluated for microstructure and mechanical properties.

EXAMPLES 4 to 9

Further Double Cemented Tungsten Carbide Composites Prepared by ROC Process

Further double cemented tungsten carbide composites were prepared in a manner similar to that described above for Example 3, except that the type of ductile binder phase material and its proportion was varied in the following manner: Example 4—approximately 36 percent by volume (i.e., less than 25 percent by weight) Grade 4650 steel; Example 5—approximately 30 percent by volume (i.e., less than 25 percent by weight) Grade 4650 steel; Example 6—approximately 38 percent by volume Sealvar Fe—Ni—Co alloy; Example 7—approximately 30 percent by volume Sealvar; Example 8—approximately 38 percent by volume cobalt; and Example 9—approximately 30 percent by volume cobalt. In each of these examples, the spherical pellets were minus 200 mesh.

Example 10

Double Cemented Tungsten Carbide Composites with Additive Prepared by ROC Process A double cemented tungsten carbide composite was prepared in a manner similar to that described above for Example 3, except that the ductile binder phase material was cobalt and included an additive of WC particles. Specifically, the composite comprised approximately 38 percent by volume ductile binder phase material and additive, based on the total weight of the composite, and approximately 10 percent by volume WC additive, based on the total weight of the ductile binder phase material and the additive. The additive was in the form of fine grain WC, having an average particle size in the range of from about 10 to 15 micrometers. The spherical pellets of cemented tungsten carbide had an average particle size in the range of from about 150 to 200 micrometers.

The double cemented tungsten carbide composites prepared according to Examples 6 to 10 were tested for such mechanical properties as hardness, fracture toughness, and wear resistance. Hardness was measured using a Rockwell A standard (HRa), fracture toughness was measured by using a $K_{Ic}$ (ksi.in$^{-1/2}$) standard test according to ASTM B771-87, and wear resistance was reported as a wear number (1,000 rev/cm$^3$) according to ASTM B-611-85. The test results are set forth in the Table below.

Table of Measure Mechanical Properties

| Sample ID | Hardness Overall HRa | Fracture Toughness, $K_{Ic}$ (ksi · in$^{-1/2}$) | Wear Resistance (1,000 rev/cm$^3$) |
|---|---|---|---|
| Example 6 | 77 | 27 | 2 |
| Example 7 | 81 | 23 | 2 |
| Example 8 | 82 | 29 | 2 |
| Example 9 | 83 | 22 | 2 |
| Example 10 | N/A | 40 | 3.8 |

As represented in the Table, the double cemented tungsten carbide composites of Examples 6 to 10 each displayed a fracture toughness ($K_{Ic}$) greater than 20 ksi.in$^{-1/2}$, and had a wear number greater than 1.5 (1,000 rev/cm$^3$) and, more specifically of approximately 2 (1,000 rev/cm$^3$). Each of the Example 6 to 10 double cemented tungsten carbide composites of this invention displayed a fracture toughness of approximately 22 or greater, and some as high as 27, 29 and 40.

Figure 5:
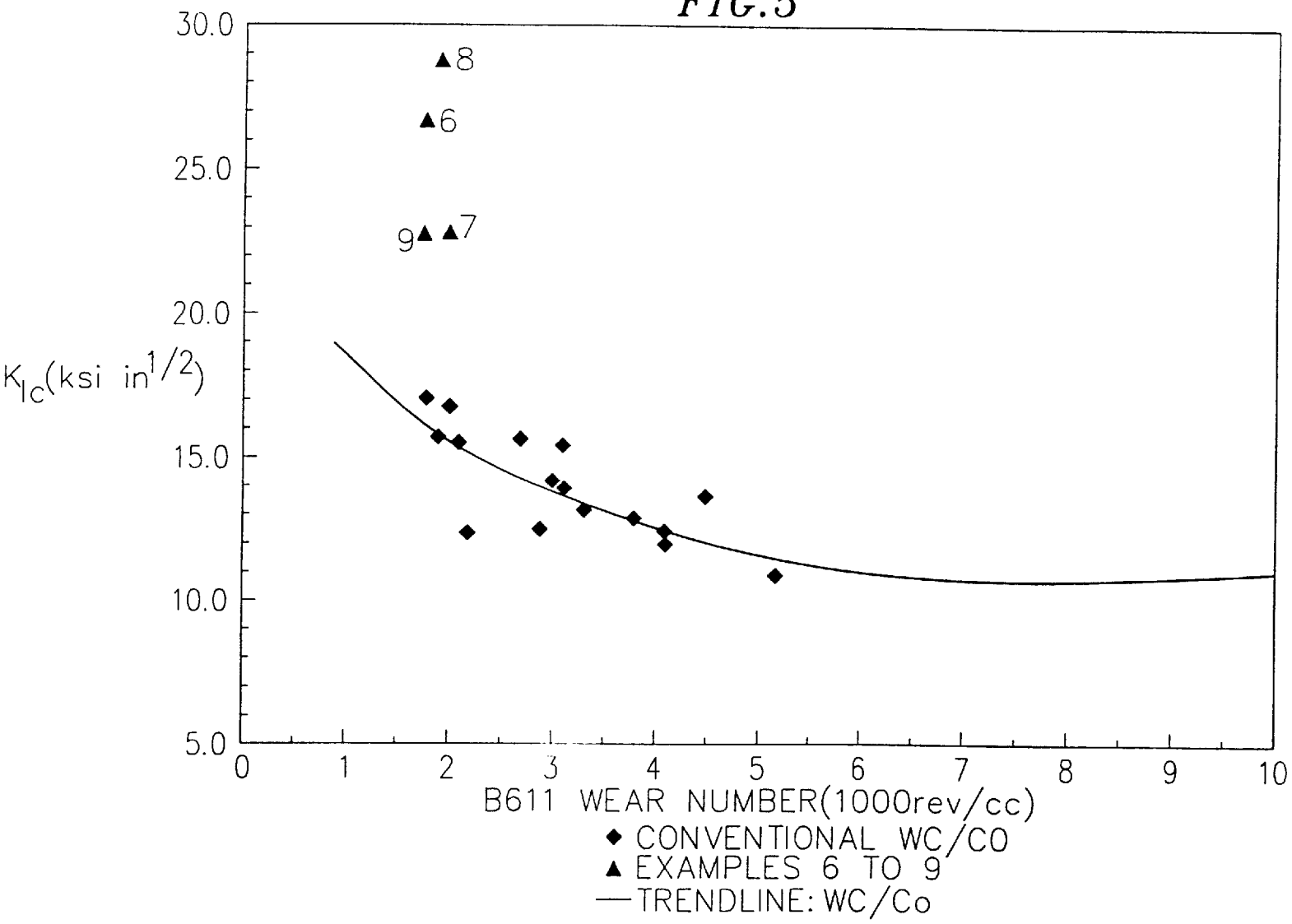
FIG. 5 is a graphical representation of the relationship between the properties of fracture toughness and wear resistance for both conventional cemented tungsten carbide and double cemented carbide composites of this invention.

FIG. 5 graphically represents the relationship between fracture toughness and wear resistance for both conventional cemented tungsten carbide materials, and for the double cemented tungsten carbide composites of Examples 6 to 9. As illustrated in FIG. 5, the fracture toughness for conventional cemented tungsten carbide materials, having a wear number of approximately two or more, is no greater than about 18 ksi.in$^{-1/2}$, and more specifically is within the range of from about 11 to 18. According to the test data, double cemented tungsten carbide composites of this invention have improved properties of fracture toughness (of at least 22 percent and as high as 60 percent) when compared to conventional cemented tungsten carbide materials, without sacrificing wear resistance.

The improved fracture toughness provided by double cemented tungsten carbide composites of this invention is a result of the special architecture of the microstructure, comprising the hard phase particles that act to control the wear rate of the composite, surrounded by the ductile binder phase that provides a crack blunting, i.e., a fracture energy absorbing, effect to thereby improve the fracture toughness of the composite.

Figure 6:
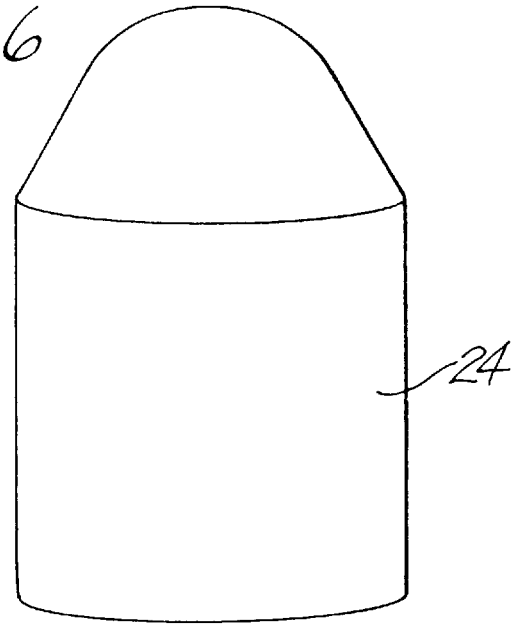
FIG. 6 is a schematic perspective side view of a double tungsten carbide composite insert.
Figure 7:
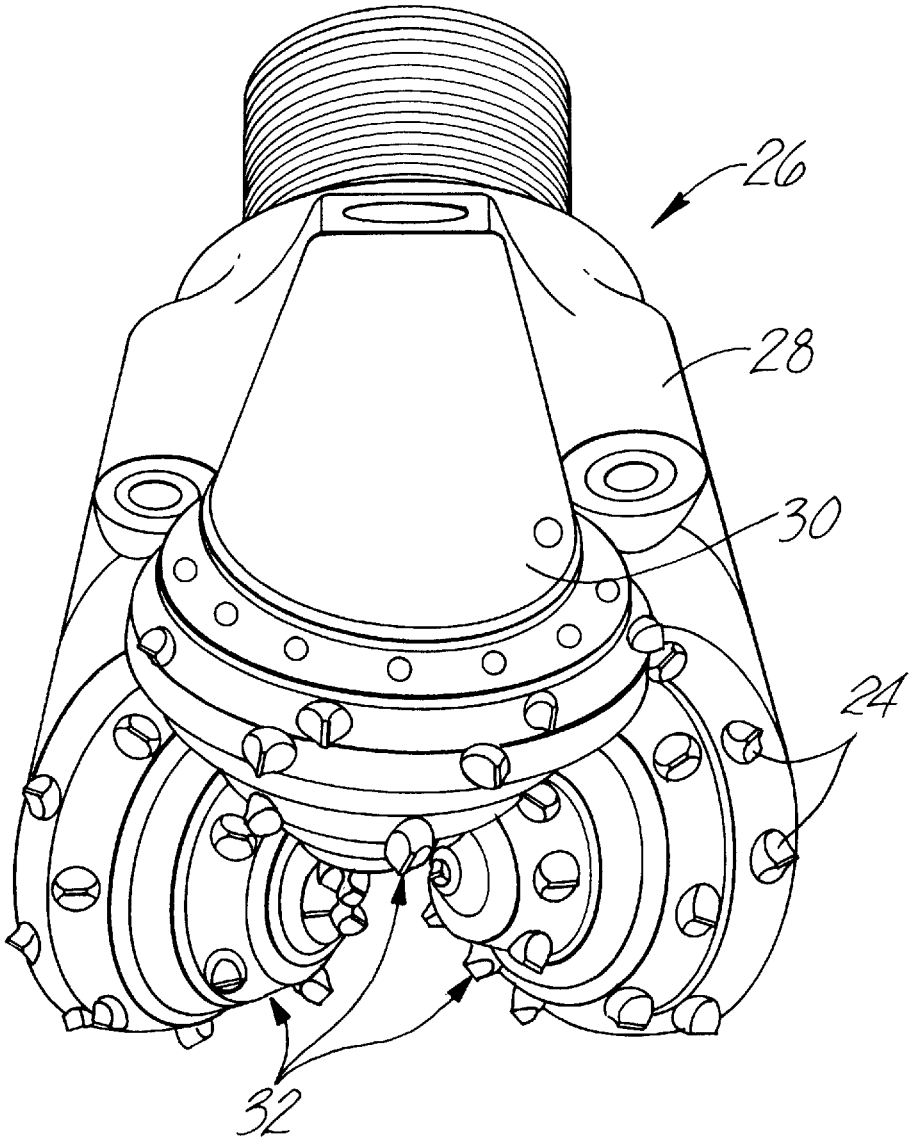
FIG. 7 is a perspective side view of a roller cone drill bit comprising a number of the inserts of FIG. 6.

Double cemented carbide composites of this invention can be used in a number of different applications, such as tools for mining and construction applications, where mechanical properties of high fracture toughness, wear resistance, and hardness are highly desired. Double cemented carbide composites of this invention can be used to form wear and cutting components in such tools as roller cone bits, percussion or hammer bits, drag bits, and a number of different cutting and machine tools. For example, referring to FIG. 6, double cemented carbide composites of this invention can be used to form a mining or drill bit insert 24. Referring to FIG. 7, such an insert 24 can be used with a roller cone drill bit 26 comprising a body 28 having three legs 30, and a cutter cone 32 mounted on a lower end of each leg. Each roller cone bit insert 24 can be fabricated according to one of the methods described above. The inserts 24 are provided in the surfaces of the cutter cone 32 for bearing on a rock formation being drilled.

Figure 8:
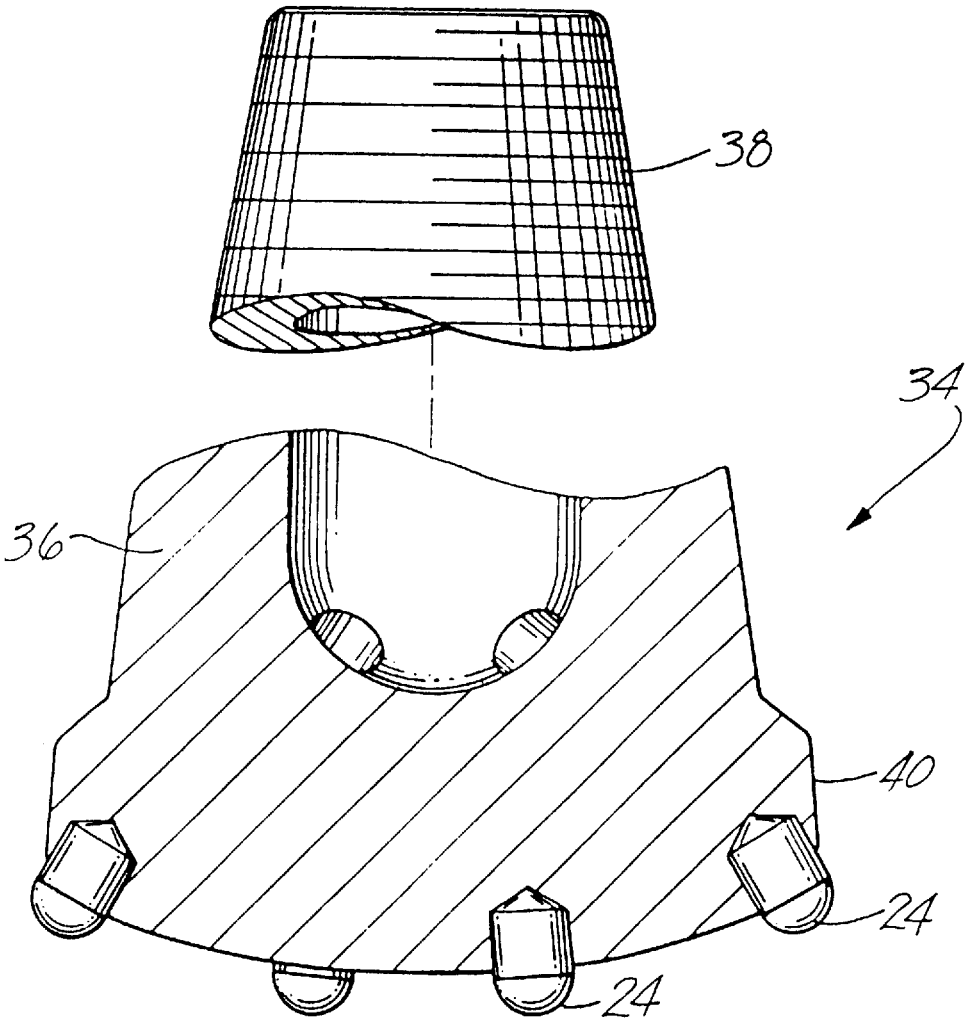
FIG. 8 is a perspective side view of a percussion or hammer bit comprising a number of inserts formed from double cemented carbide composites of this invention.

Referring to FIG. 8, inserts 24 formed from double cemented carbide composites of this invention can also be used with a percussion or hammer bit 34, comprising a hollow steel body 36 having a threaded pin 38 on an end of the body for assembling the bit onto a drill string (not shown) for drilling oil wells and the like. A plurality of the inserts 24 are provided in the surface of a head 40 of the body 36 for bearing on the subterranean formation being drilled.

Figure 9:
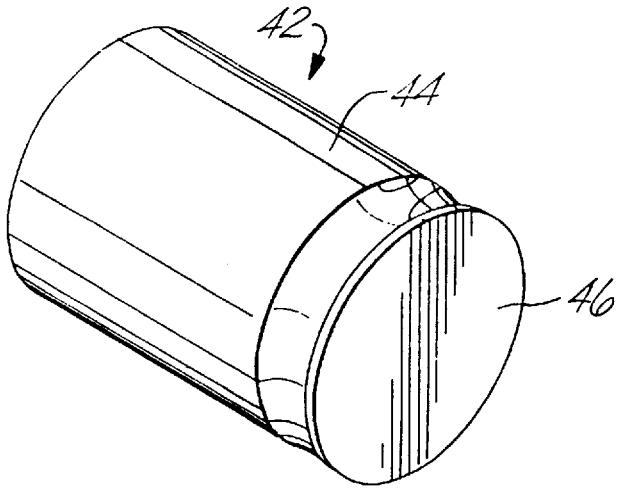
FIG. 9 is a schematic perspective side view of a polycrystalline diamond shear cutter comprising a substrate formed from double tungsten carbide composites of this invention.
Figure 10:
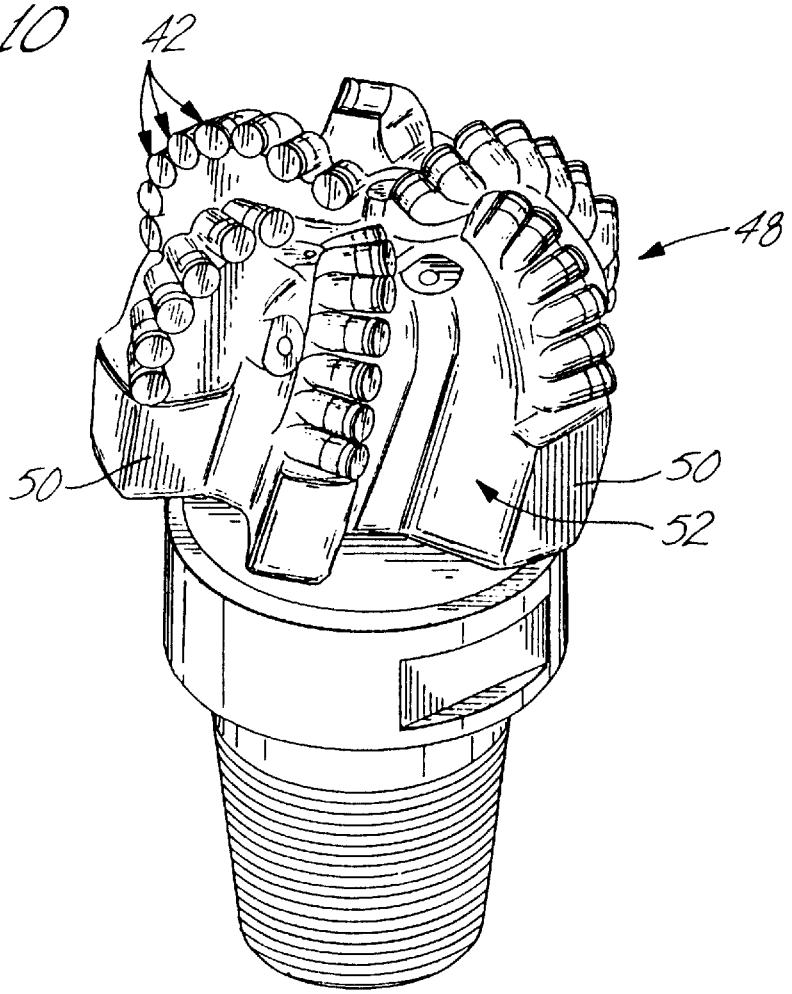
FIG. 10 is a perspective side view of a drag bit comprising a number of the polycrystalline diamond shear cutters of FIG. 9.

Referring to FIG. 9, double cemented carbide composites of this invention can also be used to form PCD shear cutters 42 that are used, for example, with a drag bit for drilling subterranean formations. More specifically, double cemented carbide composites of this invention can be used to form a shear cutter substrate 44 that is used to carry a layer of polycrystalline diamond (PCD) 46 that is sintered thereto. Referring to FIG. 10, a drag bit 48 comprises a plurality of such PCD shear cutters 42 that are each attached to blades 50 that extend from a head 52 of the drag bit for cutting against the subterranean formation being drilled.

Although, limited embodiments of double cemented carbide composites, methods of making the same, and applications for the same, have been described and illustrated herein, many modifications and variations will be apparent to those skilled in the art. Accordingly, it is to be understood that within the scope of the appended claims, double cemented carbide composites according to principles of this invention may be embodied other than as specifically described herein.

What is claimed is:

1. A composite cermet material comprising:

a plurality of first regions, each region comprising a composite of grains and a first ductile phase bonding the grains, wherein the grains are selected from the group of carbides consisting of W, Ti, Mo, Nb, V, Hf, Ta, and Cr carbides, wherein the first ductile phase is selected from the group consisting of Co, Ni, Fe, alloys thereof, and alloys with materials selected from the group consisting of C, B, Cr, Si, and Mn;

a second ductile phase separating the first regions from each other, the second ductile phase being selected from the group consisting of Co, Ni, W, Mo, Ti, Ta, V, Nb, alloys thereof, and alloys with materials selected from the group consisting of C, B, Cr, and Mn.

2. The composite material as recited in claim 1 comprising in the range of from about 40 to 95 percent by volume first regions, and less than about 60 percent by volume second ductile phase based on the total volume of the composite.

3. The composite material as recited in claim 2 comprising in the range of from about 60 to 80 percent by volume first regions and in the range of from about 20 to 40 percent by volume second ductile phase based on the total volume of the composite.

4. The composite material as recited in claim 1 having a $K_{Ic}$ fracture toughness of greater than 20 ksi.in$^{1/2}$, and a wear number of at least 1.5 (1,000 rev/cm$^3$).

5. An insert for use in a roller cone rock bit formed from the composite material of claim 1.

6. A polycrystalline diamond shear cutter substrate formed from the composite material of claim 1 and a layer of polycrystalline diamond on a face of the shear cutter substrate.

7. The composite material as recited in claim 1 wherein the second ductile phase further comprises an additive selected from the group consisting of carbides, nitrides, borides, and mixtures thereof.

8. The composite material as recited in claim 7 wherein the additive is selected from the group consisting of WC, VC, NbC, $TiB_2$, TiC, MoC, $Cr_3C_7$, polycrystalline diamond, and cBN.

9. The composite material as recited in claim 7 wherein the additive has an average particle size of less than about 20 micrometers.

10. The composite material as recited in claim 7 comprising less than about 30 percent by volume of the additive based on the total volume of the second ductile phase.

11. The composite material as recited in claim 1 wherein the first regions comprise tungsten carbide grains and a cobalt first ductile phase, and wherein the second ductile phase is cobalt.

12. The composite material as recited in claim 1 wherein the first regions comprise spherical pellets embedded in the second phase.

13. The composite material as recited in claim 1 wherein in the event that the second ductile binder is an alloyed steel, the steel comprises less than about 0.8 percent by weight carbon and has a total alloy content of less than five percent by weight based on the total weight of the second ductile binder.

14. The composite material as recited in claim 13 having a $K_{Ic}$ fracture toughness of greater than 20 ksi.in$^{1/2}$, and a wear number of at least 1.5 (1,000 rev/cm$^3$).

15. A double cemented carbide composite that is prepared by combining:

hard phase particles comprising a carbide compound and a first binder material, wherein the carbide compound is selected from the group consisting W, Ti, Mo, Nb, V, Hf, Ta, and Cr carbides, and the first binder material is selected from the group consisting of Co, Ni, Fe, alloys thereof, and alloys with materials selected from the group consisting of C, B, Cr, Si, and Mn, wherein the hard phase particles have an average particle size of less than about 500 micrometers; with a ductile second binder material separating the hard phase particles from each other, the second ductile material being selected from the group consisting of Co, Fe, Ni, W, Mo, Ti, Ta, V, Nb, alloys thereof, and alloys with materials selected from the group consisting of C, B, Cr, and Mn, and sintering the composite at a sufficient temperature for melting the second binder material;

wherein the composite has a $K_{Ic}$ fracture toughness of greater than 20 ksi.in$^{1/2}$, and a wear number of at least 1.5 (1,000 rev/cm$^3$).

16. The double cemented carbide composite as recited in claim 15 wherein the hard phase particles are substantially spherical.

17. The double cemented carbide composite as recited in claim 15 comprising in the range of from about 40 to 95 percent by volume hard phase particles and less than about 60 percent by volume of the ductile second binder material based on the total volume of the composite.

18. The double cemented carbide composite as recited in claim 15 wherein the ductile second binder material further comprises an additive ingredient selected from the group consisting of carbides, nitrides, borides, and mixtures thereof.

19. The double cemented carbide composite as recited in claim 18 wherein the additive ingredient is selected from the group consisting of WC, VC, NbC, $TiB_2$, TiC, MoC, $Cr_3C_7$, polycrystalline diamond, and cBN.

20. The double cemented carbide composite as recited in claim 19 comprising less than about 30 percent by volume of the additive ingredient based on the total volume of the ductile second binder material.

21. The double cemented carbide composite as recited in claim 15 wherein in the event that the second ductile binder material comprises an alloyed steel it comprises less than 0.8 percent by weight carbon and has a total alloy content of less than five percent by weight based on the total weight of the second ductile binder material.

22. A double cemented carbide composite comprising:

hard particles of tungsten carbide cemented with a first cobalt binder; and a second cobalt binder surrounding the hard particles.

23. The double cemented carbide composite as recited in claim 22 wherein the hard particles are substantially spherical.

24. The double cemented carbide composite as recited in claim 22 comprising hard particles in the range of from 60 to 80 percent by volume of the total composite.

25. The double cemented carbide composite as recited in claim 22 wherein the hard particles have an average particle size of less than about 500 micrometers.

26. The double cemented carbide composite as recited in claim 22 wherein the composite has a $K_{Ic}$ fracture toughness of greater than 20 ksi.in$^{1/2}$, and a wear number of at least 1.5 (1,000 rev/cm$^3$).

27. The double cemented carbide composite as recited in claim 22 wherein the second cobalt binder further comprises additives selected from the group consisting of carbides, nitrides, borides, and mixtures thereof.

28. The double cemented carbide composite as recited in claim 22 wherein the additive is selected from the group consisting of WC, VC, NbC, $TiB_2$, TiC, MoC, $Cr_3C_7$, polycrystalline diamond, and cBN.

29. A double cemented carbide composite comprising:

hard particles of tungsten carbide cemented with a first cobalt binder; and a second binder surrounding the hard particles formed from a material having a coefficient of thermal expansion less than about 8 $\mu$m/m-K.

30. A roller cone drill bit comprising:

a body having a number of legs that extend therefrom;

cutting cones rotatably disposed on an end of each leg;

a plurality of cutting inserts disposed in the cutting cones, wherein at least a portion of the cutting inserts are formed from a double cemented carbide composite comprising:

a plurality of first regions, each region comprising a composite of grains and a first ductile phase bonding the grains, wherein the grains are selected from the group of carbides consisting of W, Ti, Mo, Nb, V, Hf, Ta, and Cr carbides, wherein the first ductile phase is selected from the group consisting of Co, Ni, Fe, alloys thereof, and alloys with materials selected from the group consisting of C, B, Cr, Si, and Mn; and a second ductile phase separating the first regions from each other, the second ductile phase being selected from the group consisting of Co, Ni, Fe, W, Mo, Ti, Ta, V, Nb, alloys thereof, and alloys with materials selected from the group consisting of C, B, Cr, and Mn.

31. The roller cone drill bit as recited in claim 30 wherein in the event that the second ductile phase comprises an alloyed steel it comprises less than 0.8 percent by weight carbon and has a total alloy content of less than five percent by weight based on the total weight of the second ductile phase.

32. The roller cone drill bit as recited in claim 31 wherein the double cemented carbide composite comprises in the range of from about 40 to 95 percent by volume first regions, and less than about 60 percent by volume second ductile phase based on the total volume of the composite.

33. The roller cone drill bit as recited in claim 31 wherein the double cemented carbide composite comprises in the range of from about 60 to 80 percent by volume first regions and in the range of from about 20 to 40 percent by volume second ductile phase based on the total volume of the composite.

34. The roller cone drill bit as recited in claim 31 wherein the double cemented carbide composite has a $K_{Ic}$ fracture toughness of greater than 20 ksi.in$^{1/2}$, and a wear number of at least 1.5 (1,000 rev/cm$^3$).

35. The roller cone drill bit as recited in claim 31 wherein the second ductile phase further comprises an additive selected from the group consisting of carbides, nitrides, borides, and mixtures thereof.

36. The roller cone drill bit as recited in claim 35 wherein the additive is selected from the group consisting of WC, VC, NbC, $TiB_2$, TiC, MoC, $Cr_3C_7$, polycrystalline diamond, and cBN.

37. The roller cone drill bit as recited in claim 31 wherein the first regions comprise substantially spherical pellets of cemented tungsten carbide.

38. The roller cone drill bit as recited in claim 31 wherein the first regions comprise tungsten carbide grains and a cobalt first ductile phase, and wherein the second ductile phase is cobalt.

39. A percussion drill bit comprising:

a body having a head with a surface adapted to engage a subterranean formation during drilling;

a plurality of inserts disposed in head surface, wherein the inserts are formed from a double cemented carbide composite comprising:

a plurality of first regions, each region comprising a composite of grains and a first ductile phase bonding the grains, wherein the grains are selected from the group of carbides consisting of W, Ti, Mo, Nb, V, Hf, Ta, and Cr carbides, wherein the first ductile phase is selected from the group consisting of Co, Ni, Fe, alloys thereof, and alloys with materials selected from the group consisting of C, B, Cr, Si, and Mn; and a second ductile phase separating the first regions from each other, the second ductile phase being selected from the group consisting of Co, Ni, Fe, W, Mo, Ti, Ta, V, Nb, alloys thereof, and alloys with materials selected from the group consisting of C, B, Cr, and Mn.

40. The percussion drill bit recited in claim 39 wherein the first regions comprise substantially spherical pellets of cemented tungsten carbide.

41. A drag drill bit comprising:

a body having a head and having a number of blades extending away from a head surface, the blades being adapted to engage a subterranean formation during drilling;

a plurality of shear cutters disposed in the blades to contact the subterranean formation during drilling, each shear cutter comprising a substrate and a layer of cutting material disposed thereon, the substrate being formed from a double cemented carbide composite comprising:

a plurality of first regions, each region comprising a composite of grains and a first ductile phase bonding the grains, wherein the grains are selected from the group of carbides consisting of W, Ti, Mo, Nb, V, Hf, Ta, and Cr carbides, wherein the first ductile phase is selected from the group consisting of Co, Ni, Fe, alloys thereof, and alloys with materials selected from the group consisting of C, B, Cr, Si, and Mn; and a second ductile phase separating the first regions from each other, the second ductile phase being selected from the group consisting of Co, Ni, Fe, W, Mo, Ti, Ta, V, Nb, alloys thereof, and alloys with materials selected from the group consisting of C, B, Cr, and Mn.

* * * * *